US006823705B2

(12) United States Patent
Fukuda et al.

(10) Patent No.: US 6,823,705 B2
(45) Date of Patent: Nov. 30, 2004

(54) SEQUENTIAL FORMING DEVICE

(75) Inventors: Kouji Fukuda, Tokyo (JP); Shigeo Ozawa, Tokyo (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/367,946

(22) Filed: Feb. 19, 2003

(65) Prior Publication Data

US 2003/0154757 A1 Aug. 21, 2003

(30) Foreign Application Priority Data

Feb. 19, 2002 (JP) ..... 2002-041919

(51) Int. Cl.[7] ..... B21D 22/00
(52) U.S. Cl. ..... 72/214; 72/379.2
(58) Field of Search ..... 72/214, 343, 466.8, 72/75, 379.2

(56) References Cited

U.S. PATENT DOCUMENTS

| | | | | | |
|---|---|---|---|---|---|
| 2,829,545 | A | * | 4/1958 | Eckold | 72/466.8 |
| 3,152,393 | A | * | 10/1964 | Johnson | 72/374 |
| 3,342,051 | A | * | 9/1967 | Leszak | 72/81 |
| 2001/0029768 | A1 | * | 10/2001 | Okada et al. | 72/343 |

FOREIGN PATENT DOCUMENTS

| | | | | | |
|---|---|---|---|---|---|
| EP | 1 147 832 | A2 | | 10/2001 | |
| JP | 48-48359 | B | | 7/1973 | |
| JP | 5-42328 | A | | 2/1993 | |
| JP | 8-1625 | A | | 1/1996 | |
| JP | 9-85355 | A | | 3/1997 | |
| JP | 10-296345 | A | | 11/1998 | |
| JP | 10296345 | A | * | 11/1998 | ..... B21D/22/14 |
| JP | 11-57874 | A | | 3/1999 | |
| JP | 11-285741 | A | | 10/1999 | |
| JP | 2000-301248 | A | | 10/2000 | |
| JP | 2000301248 | A | * | 10/2000 | ..... B21D/22/24 |
| JP | 2001-334814 | A | | 12/2001 | |
| JP | 2002-1444 | A | | 1/2002 | |
| JP | 2002-102945 | A | | 4/2002 | |
| JP | 2003-53436 | A | | 2/2003 | |

* cited by examiner

*Primary Examiner*—Lowell A. Larson
(74) *Attorney, Agent, or Firm*—Birch, Stewart, Kolasch & Birch, LLP

(57) ABSTRACT

A plate member (10) is mounted on a supporting frame (11). The periphery of the plate member (10) is firmly secured by a clamp (12) and a concave die-shaped lower pushing member (13) is caused to rise from below. The lower pushing member (13) is provided with a forming concave area (15) and a forming convex area (16). Disposed above the plate member (10) is a bar-shaped upper pushing member (20) which is lowered to push against the plate member (10). In such a condition, the plate member (10) is caused to rise together with the lower pushing member (13) and move in the directions of X and Y to form convex areas (17) and (18) within the forming concave area (15) and the forming convex area (16). The upper pushing member (20) is provided with a main body (21) of high rigidity and a flexible member (22). The flexible member (22) is formed in a hemispherical shape and made of material more elastic than the main body (21) which is made of hard polyurethane or the like, thereby making spherical contact with the plate member (10).

8 Claims, 8 Drawing Sheets

SEQUENTIAL FORMING DEVICE

BACKGROUND OF THE INVENTION

1. Field of the Invention

The present invention relates to a device used in sequential forming. The sequential forming is a well-known method whereby a pushing member of a bar shape, a convex shape or a concave shape is provided to push on a metal member such as a metal sheet, wherein the metal member and the pushing member are caused to move relatively to have the plate member formed into a predetermined three dimensional shape such as a shell shape. In the present invention, two axial directions perpendicular to each other within a plane of the plate member before forming are referred to X and Y, while an axial direction perpendicular to each of them is referred to Z.

2. Description of the Prior Art

The sequential forming and the sequential forming device are disclosed in WO99/38627 and the like. For example, the sequential forming is disclosed in Japanese Unexamined Patent Publication No. Hei 5-42328 (1993). According to this sequential forming, four corners of a plate member are horizontally supported by crease controllers, and a lower pushing member of a convex shape is pushed up onto the plate member from below to have the plate member preliminarily drawn into a rough shape. By pushing a bar-shaped upper pushing member onto the plate member from above to move the plate member in the directions of X and Y and then moving the pushing member in the Z direction, a desired three-dimensional shape is formed.

In a conventional sequential forming, a plate member is extended or rolled by a bar-shaped pushing member to copy the surface of a lower pushing member formed as a convex die for forming. In this case, a shape of the formed surface is generally not uniform and thus the plate redundancy is caused. Accordingly, in an outer sheet for an automobile or the like which has a gently curved surface and the shape is not provided with high rigidity, creases are caused on the periphery. Since the pushing member with high rigidity is pushed onto the plate member in a point contact condition, there is easily caused striped tool marks on the surface of the plate member. It is therefore an object of the present invention to provide a sequential forming device which can prevent such creases or tool marks from being produced.

SUMMARY OF THE INVENTION

To solve the problems above, a sequential forming device according to one aspect of the present invention comprises a plate member having the periphery supported and a bar-shaped pushing member adapted to push on the plate member from one side, wherein a contacting section between the plate member and the bar-shaped pushing member is caused to move in the three-dimensional direction to have the plate member formed into a predetermined three-dimensional shape, characterized in that a section of the bar-shaped pushing member contacting with the plate member is a flexible member.

The sequential forming device according to another aspect of the present invention comprises a plate member having the periphery supported, a bar-shaped pushing member adapted to push on the plate member from one side, a die-shaped pushing member adapted to push on the plate member from the other side, the plate member being inserted between the bar-shaped pushing member and the die-shaped pushing member, wherein a contacting section between the plate member and the bar-shaped pushing member is caused to move in the three-dimensional direction to have the plate member formed into a predetermined three-dimensional shape, characterized in that the die-shaped pushing member is concave die.

The sequential forming device according to yet another aspect of the present invention includes a flexible member which is hemispheric.

The sequential forming device according to yet another aspect of the present invention includes a flexible member which is cylindrical and pivotably supported onto a tip section of the bar-shaped pushing member.

According to the present invention, since a section of a bar-shaped pushing member contacting with a plate member is a flexible member, the section does not make a point contact with the surface of the plate member when formed. It is therefore possible to prevent the tool marks from being produced.

Since the die-shaped pushing member is a concave die, the plate member is pushed and spread into the concave space of a lower die by the bar-shaped pushing member for forming. In this manner, it is possible to prevent the creases from being produced on the periphery of the forming section. Further, since the contacting section of the bar-shaped pushing member with the plate member is a flexible member, it is also possible to prevent the tool marks from being produced.

Since the flexible member is hemispheric, it makes a spherical contact with the plate member. Accordingly, the contacting section between the bar-shaped pushing member and the plate member becomes large to make the movement smooth. It is also possible to prevent the tool marks from being produced.

Since the flexible member is cylindrical and pivotably supported onto the tip section of the pushing member, the flexible member is adapted to contact the surface of the plate member rolling thereon. Accordingly, less friction results between the pushing member and the plate member thereby making the movement smooth.

DETAILED DESCRIPTION OF THE PREFERRED EMBODIMENTS

Figure 1:
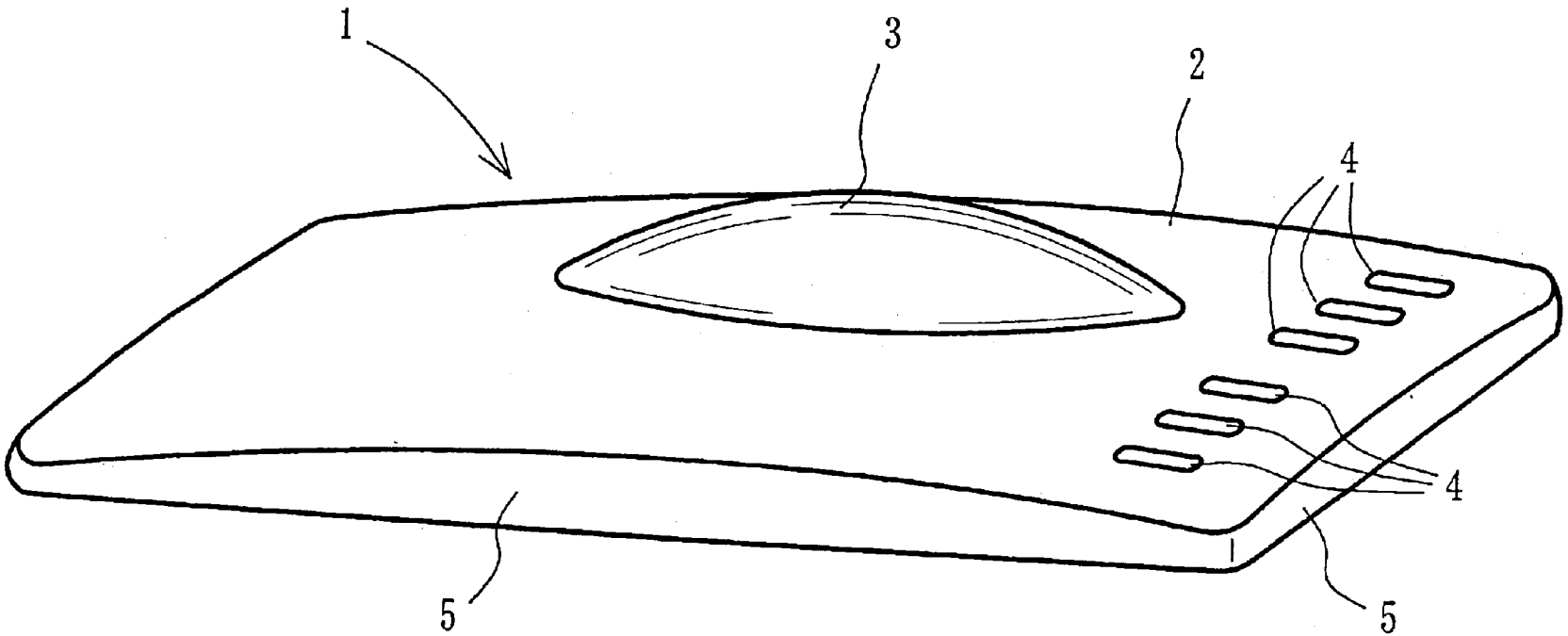
FIG. 1 is an external appearance view of a product formed by a sequential forming.
Figure 2:
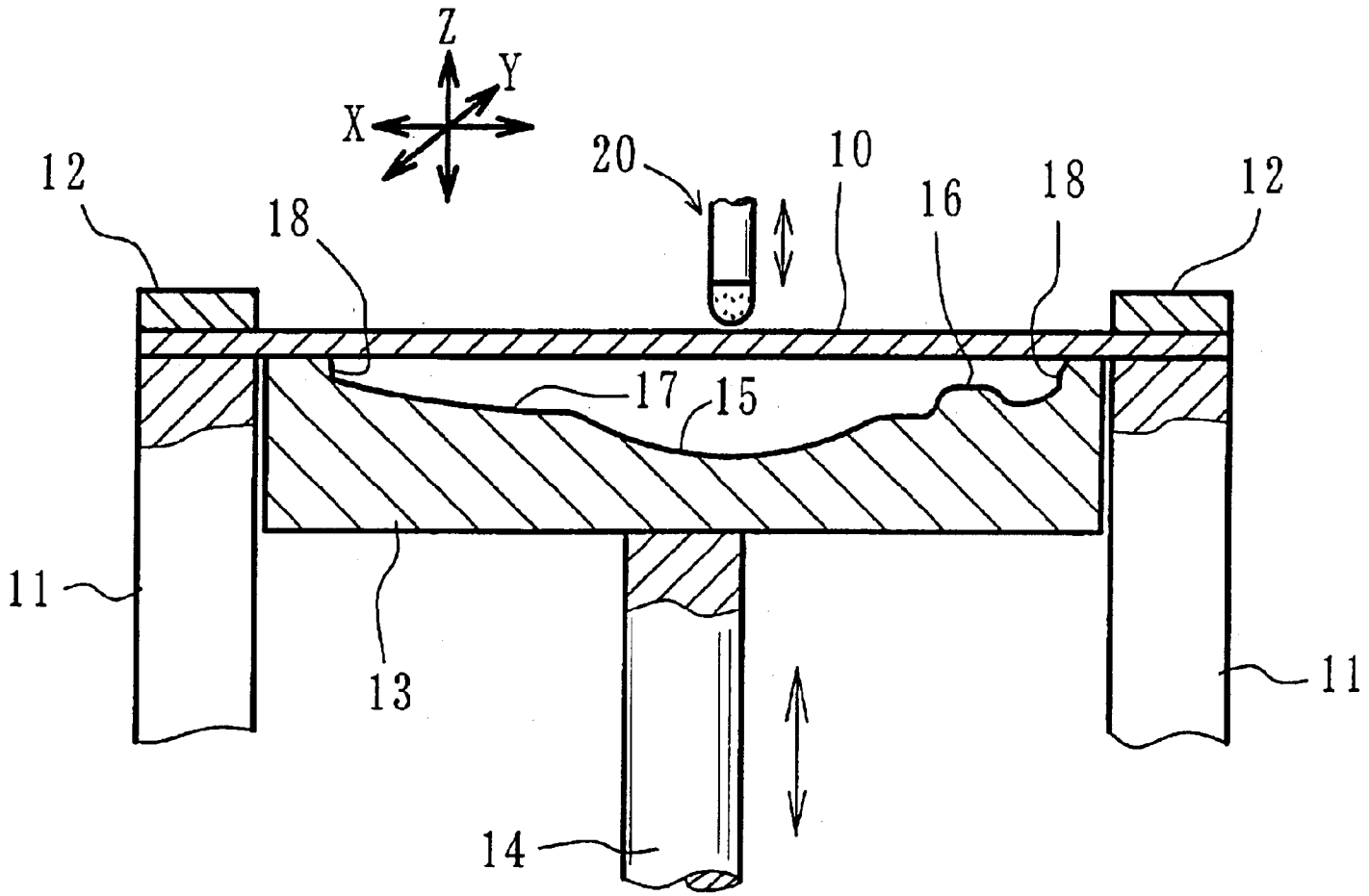
FIG. 2 is a cross-sectional view showing the principle of a sequential forming device.
Figure 3:
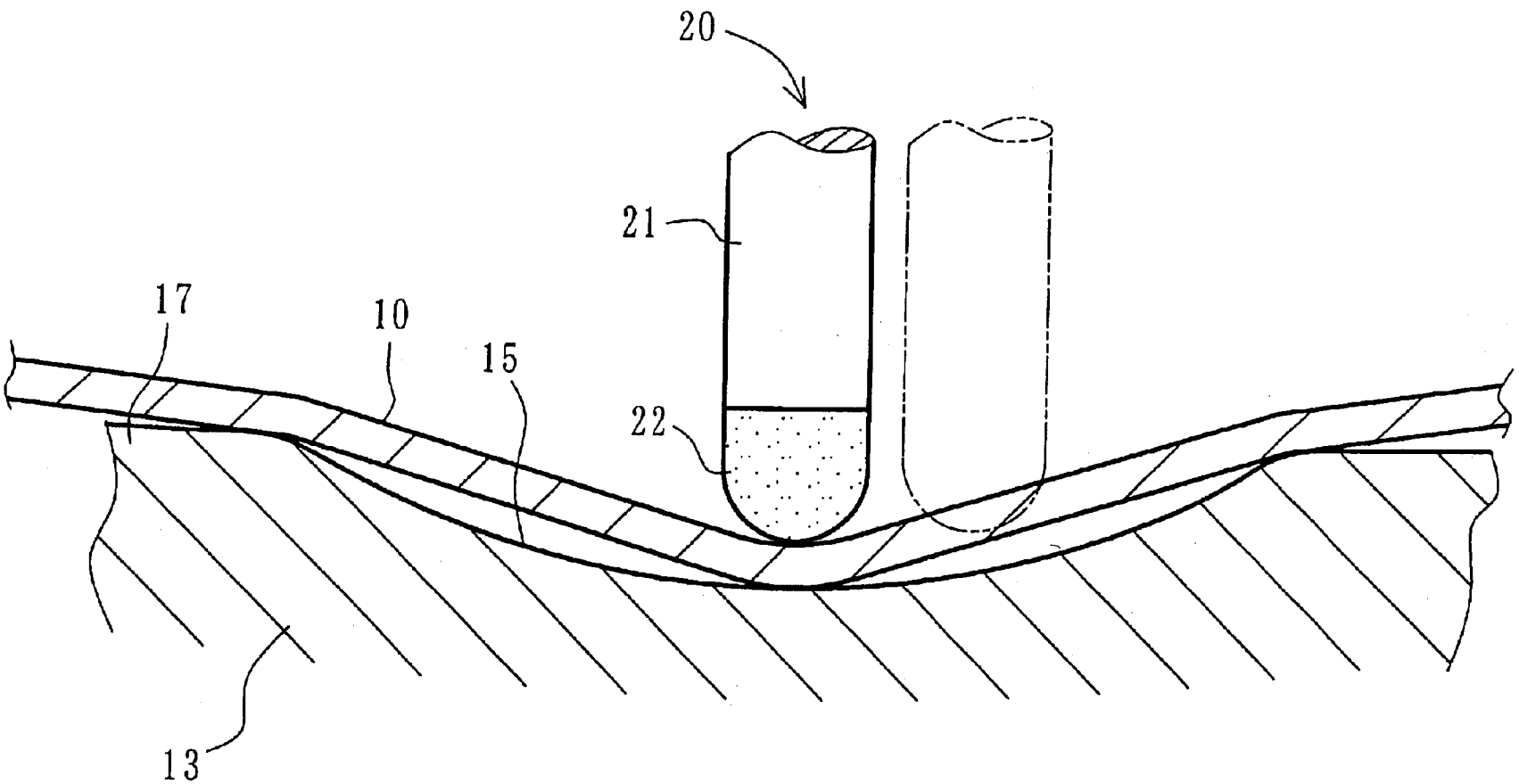
FIG. 3 is a view showing the principle of sequential forming in a forming concave area.
Figure 4:
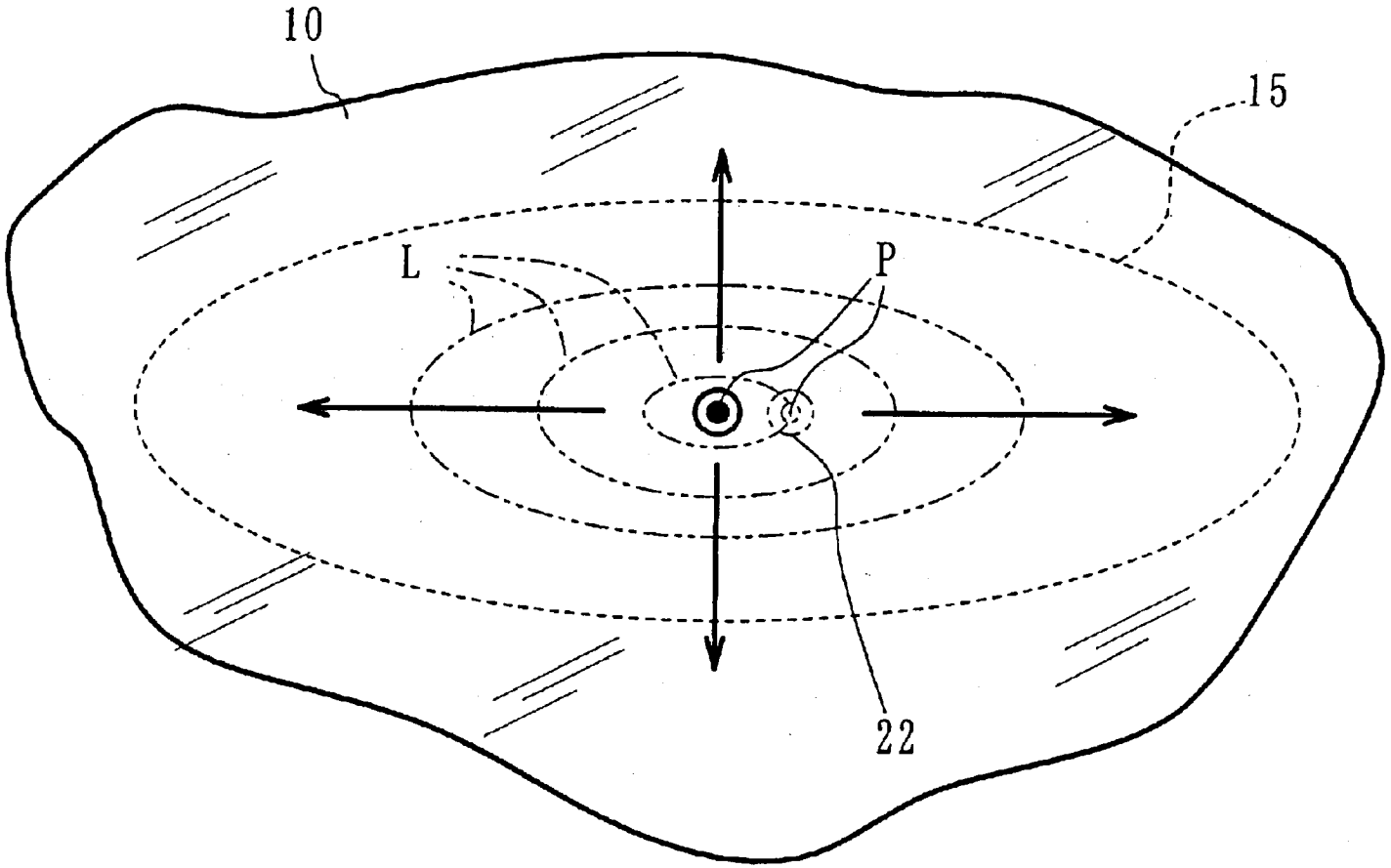
FIG. 4 is a view showing how to describe a contour line in the sequential forming.
Figure 5:
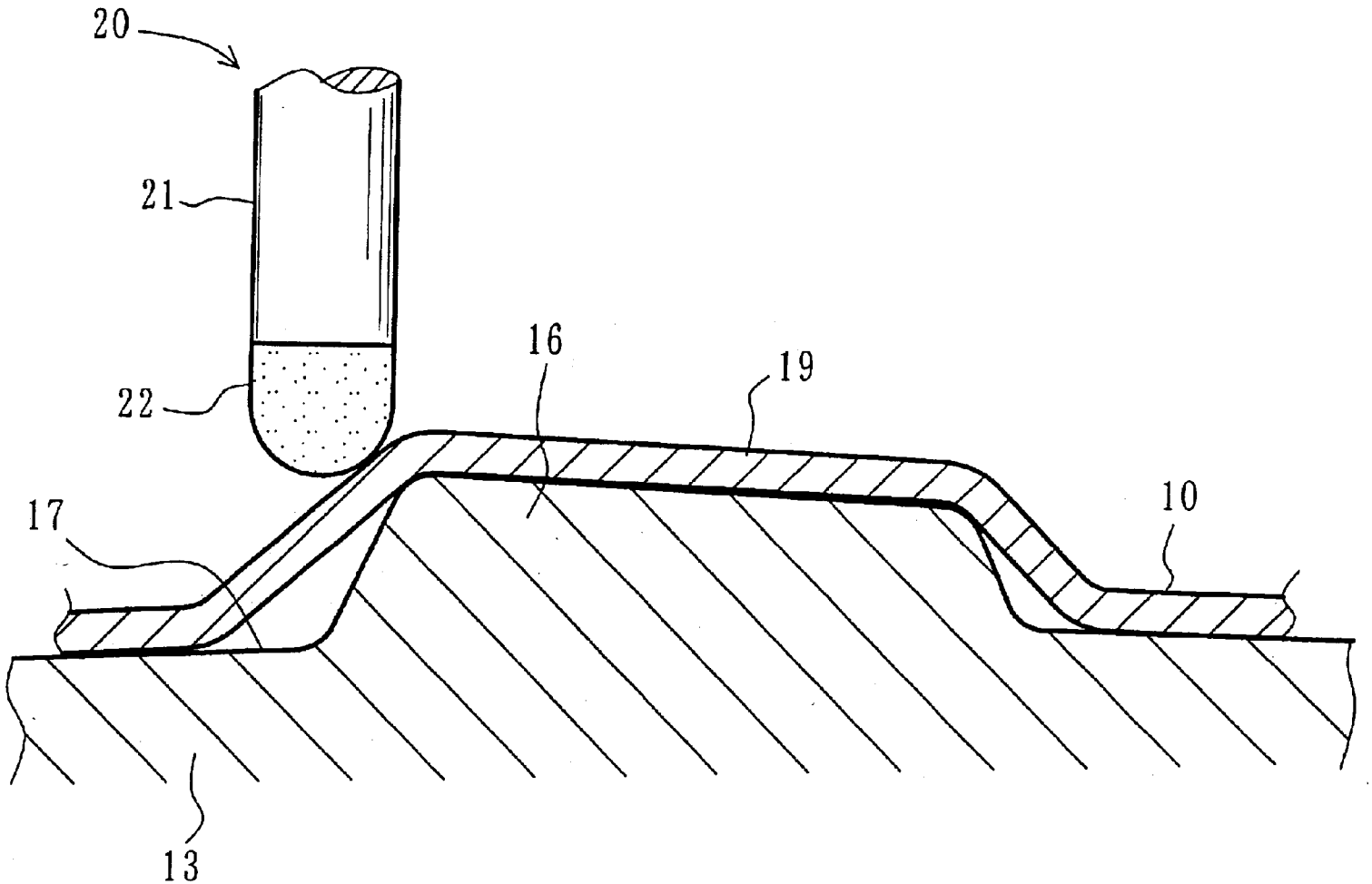
FIG. 5 is a view showing the principle of the sequential forming in a forming convex area.
Figure 6:
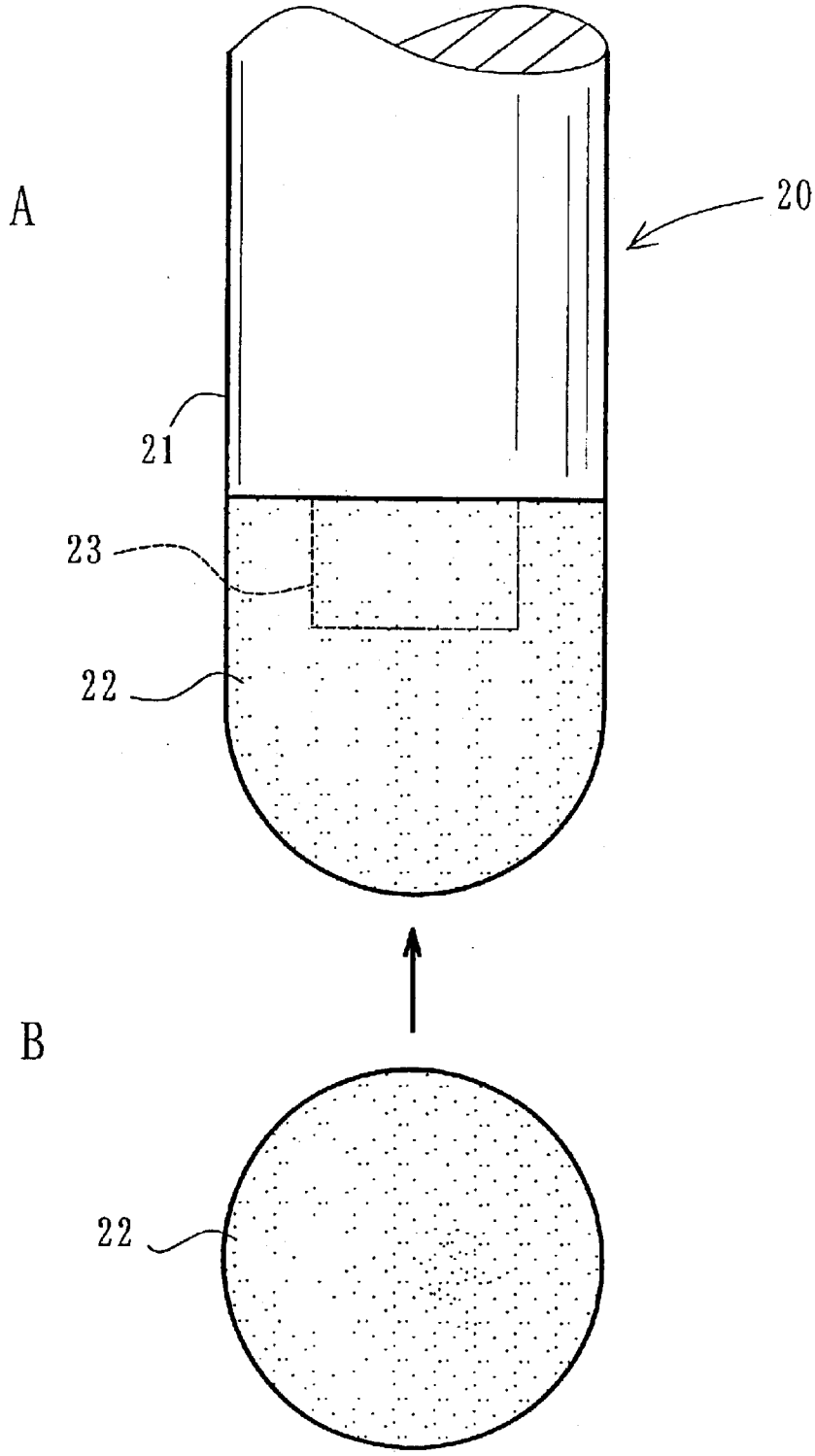
FIG. 6 is a view showing a structure of a pushing member.
Figure 7:
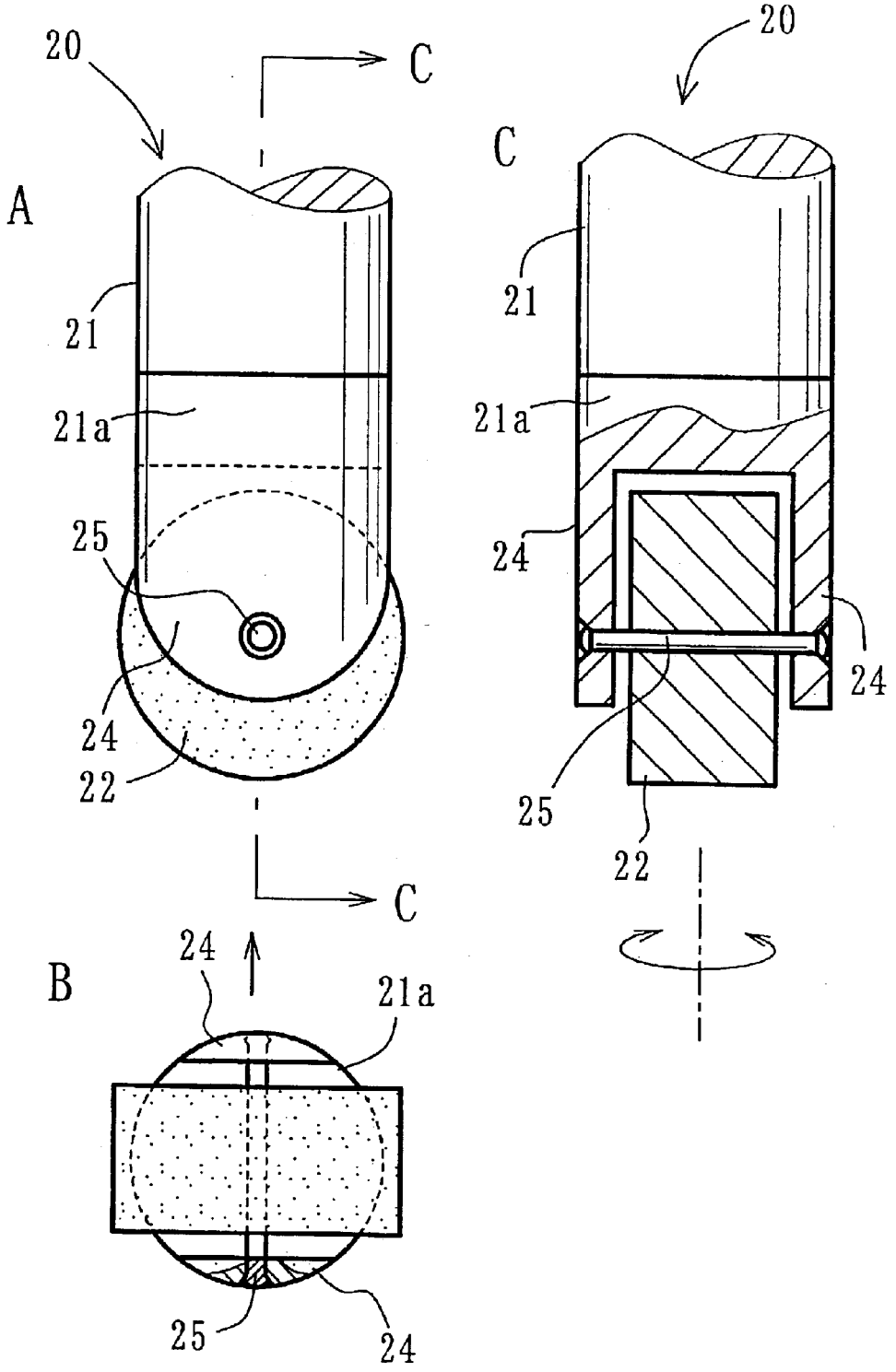
FIG. 7 is a view showing another structure of the pushing member.
Figure 8:
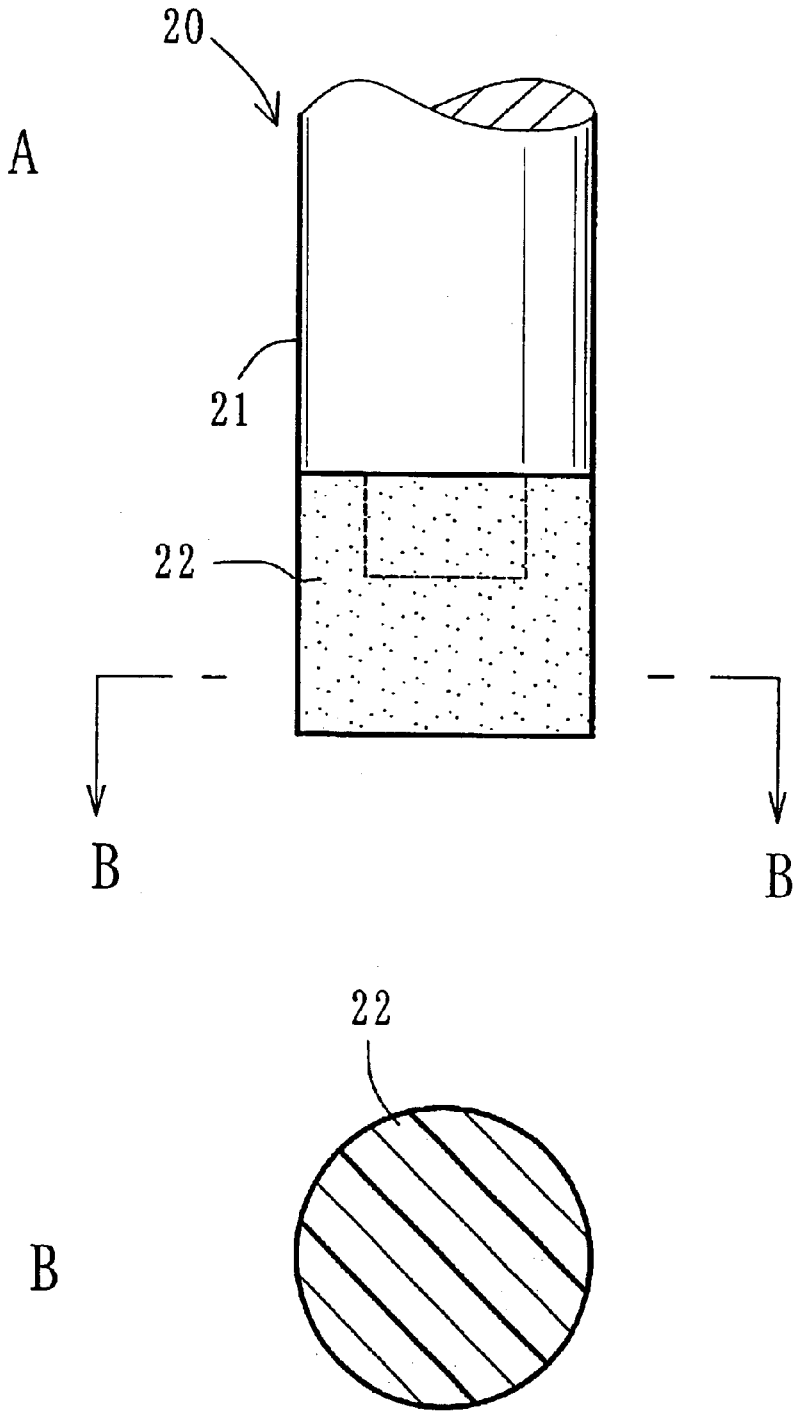
FIG. 8 is a view showing a still further structure of the pushing member.

One embodiment of the present invention will be described with reference to the accompanying drawings. FIG. 1 shows an external appearance of a formed product obtained by the present sequential forming. FIG. 2 shows a principle of a sequential forming device and FIG. 3 is a partially enlarged cross-sectional view showing a principle of the sequential forming in a forming concave area. FIG. 4 is a view explaining a contour line described by a contacting section between a plate member and an upper pushing member. FIG. 5 is a partially enlarged cross-sectional view showing a principle of the sequential forming in a forming convex area. FIG. 6 is view showing a flexible member in a tip section of the pushing member. FIGS. 7 and 8 are views respectively showing the other embodiment of the flexible member.

Referring first to FIG. 1, a bonnet 1 is a sequential forming product of the present invention formed into a three-dimensional shape which becomes a surface shape of an automobile bonnet from a steel plate. The upper surface 2 of the bonnet 1 is formed to provide a gentle curved surface and partially provided with a convex area 3 projecting upward and having a substantially oval shape in plan view. There is provided a plurality of vent holes 4 on the end section of the bonnet 1. A flange-shaped wall 5 is provided on the periphery to provide a three-dimensional shell construction as a whole.

As shown in FIG. 2, a sequential forming device is provided, in which the periphery of a plate member 10 is mounted on a supporting frame 11 to be secured by a clamp 12. A lower pushing member 13 is provided below the plate member 10 to be vertically moveable by an elevating shaft 14, while a bar-shaper pushing member 20 is provided above the plate member 10 to be vertically moveable. The lower pushing member 13 is pushed on the plate member 10 from below, while the upper pushing member 20 is lowered from above to push on the plate member 10. In this manner, the plate member 10 is caused to move in the directions of X, Y, and Z so that the plate member 10 is deformed to copy the surface of the lower pushing member 13.

The upper pushing member 20 and the lower pushing member 13 correspond to a bar-shaped pushing member and a die-shaped pushing member in the present invention, respectively. One or both of them can be moved in two directions of X and Y perpendicular to each other on the same plane. The upper pushing member 20 and the lower pushing member 13 can also move in the Z direction (i.e., the vertical direction in the figure) which is perpendicular to these X and Y directions. Details of these moving mechanism are omitted here, but various mechanisms are known from the conventional techniques or the like.

In the following description, it is to be understood that the lower pushing member 13 can freely move in the X and Y directions together with the plate member 10, the supporting frame 11, and the clamp 12, while only the lower pushing member 13 is vertically moveable in the Z direction relative to the plate member 10, the supporting frame 11, and the clamp 12. On the other hand, the upper pushing member 20 is supported to be vertically moveable in the Z direction by a suitable supporting member in a space above the plate member 10 independently of them.

Further, one or both of the upper pushing member 20 and the lower pushing member 13 are designed to exert such a pushing force as to plastic deform the plate member 10. In the following description, this pushing force is applied from the lower pushing member 13 side, and the upper pushing member 20 is designed to be supported above the plate member 10 so that it can sufficiently receive the pushing force.

The plate member 10 is a plate-shaped material made of an iron system or other metals. It is, for example, an iron-made sheet metal with a thickness of about 0 point something mm~several mm. However, the material of the metal member 10 can be optionally chosen from a light alloy such as aluminum or other metals which are suitable for deformation processing. Thickness of the metal member 10 can also be optionally chosen in the same manner as above.

The supporting frame 11 can have a suitable frame shape such as a rectangular shape, and the lower pushing member 13 is provided in a space inside the supporting frame 11. The supporting frame 11 is supported together with the clamp 12 by a support in common with the lower pushing member 13. The support is moveably provided in the X and Y directions. Only the lower pushing member 13 is provided to be vertically moveable on the support by the elevating shaft 14 in the Z direction independently of the supporting frame 11 and the clamp 12. When pushed up, the lower pushing member 13 contacts with the lower surface of the plate member 10.

The lower pushing member 13 is a concave die having a forming concave area of a size and shape which forms the upper surface of the bonnet 1. The lower pushing member 13 is provided with a forming concave area 15 of a substantially oval shape of which the central section is large and deep corresponding to a convex area 3 of the bonnet 1. The lower pushing member 13 is also provided with a forming convex area 16 of which the peripheral section has small steps corresponding to the vent holes 4. Reference numeral 17 in the figure is a forming concave area of which the curved surface is shallow and gentle corresponding to the upper surface 2 of the bonnet 1 excluding the convex area 3 and the vent holes 4. Reference numeral 18 is a peripheral wall corresponding to a peripheral or surrounding wall 5.

As shown in FIG. 6, the upper pushing member 20 is provided with a round bar-shaped main body 21 made of a suitable material which is much more rigid than the plate member 10 made of cemented carbide or the like. The upper pushing member 20 is also provided with a hemispheric flexible member 22 which is integrally formed with the tip section of the main body 21 by a suitable method. FIG. 6A shows the upper pushing member 20 from the direction perpendicular to the axis and FIG. 6B shows the flexible member 22 as seen from the direction of an arrow of FIG. 6A.

The flexible member 22 is made of a suitable material such as rigid polyurethane which has a moderate hardness softer than and higher elasticity than the main body 21 and which is superior in wear-resistant properties. The flexible member 22 is formed hemispheric and the tip section thereof is provided to make a spherical contact with the plate member 10. A securing mechanism of the flexible member 22 onto the main body 21 can be optionally selected. For example, the main body 21 is provided with a convex area 23 of a smaller diameter, while the flexible member 22 is provided with a hole to correspond to the convex area 23. After the convex area 23 is fitted into the hole, they can be integrally united using adhesion or the like.

Operation of the present embodiment will now be explained. In FIG. 2, the upper pushing member 20 is pushed down to allow the flexible member 22 to contact with the upper surface of the plate member 10. Then, the lower pushing member 13 is pushed up to adjust each position in the directions of X, Y, and Z so that the central section of the forming concave area 15 is situated below the flexible member 22.

When the lower pushing member 13 is further pushed up from such a condition, a section of the plate member 10 of which the upper surface is pushed down by the flexible member 22 is pushed into the central section of the forming concave area 15 (see FIG. 3). Thus, the section of the plate member 10 pushed by the flexible member 22 is pushed onto the deepest section of the forming concave area 15 in the example shown by the figure.

In this condition, as shown in a fictitious line, the plate member 10 is caused to move in the lateral (X-Y) direction so that the upper pushing member 20 can shift its position by about the size. Next, the lower pushing member 13 is caused to move in the Z direction to adjust the height and the plate member 10 is caused to move in the X-Y direction so that the contacting section of the flexible member 22 can describe, for example, a contour line. In this manner, the plate member 10 is deformed so that the adjacent section contact with the inner surface of the forming concave area 15. If this operation is repeated toward the outside, it is possible to form the convex area copying the inner surface of the forming concave area 15.

FIG. 4 explains the movement according to the contour line. The flexible member 22 is moved relative to the plate member 10 so that the contacting section P between the flexible member 22 and the plate member 10 describes the closed contour line L. Once description of one contour line L is completed, the contacting point P is moved outside to describe another contour line L of a substantially similar figure to the previous one. This operation is repeated until the contour line I, reaches the outer edge section of the forming concave area 15.

With this operation, the section of the plate member 10 situated above the forming concave area 15 is pushed and spread into the forming concave area 15 by the flexible member 22 to provide a convex area projecting downward. In this manner, the convex area copying the inner surface of the forming concave area 15 is formed. Thus, a convex area 3 of the bonnet 1 shown in FIG. 1 is provided.

In the sequential forming, when the contacting section between the flexible member 22 and the plate member 10 is caused to move, it can be moved to allow the contour line L to gradually expand from the central section of the forming area to the outside. On the contrary, the contacting section can also be moved form the outside to the central section. Also, by firmly securing the lower pushing member 13, the upper pushing member 20 side can be moved in the directions of X, Y, and Z, or both the upper and lower pushing members can be moved at the same time.

Next, the sequential forming of a section corresponding to a forming convex area 16 is also carried out in the same manner as above. FIG. 5 explains this process. When the lower pushing member 13 is first pushed up, a section of the plate member 10 is caused to project upward by the forming convex area 16 as preliminary forming. Then, the flexible member 22 is caused to move onto a shoulder section of the forming convex area 16. If the lower pushing member 13 and the plate member 10 are caused to selectively move in the directions of X, Y, and Z so that the contacting section between the flexible member 22 and the plate member 10 moves on the periphery of the forming convex area 16, a step section 19 for forming vent holes 4 is formed.

Subsequently, in the same manner as above, the plate member 10 is sequentially formed to copy the forming concave area 17 excluding the forming concave area 15 and the forming convex area 16. As a result, a section corresponding to the upper surface 2 of the bonnet 1 is formed as a gentle curved surface. Further, the inside of the peripheral wall 18 is formed to provide a section corresponding to the surrounding or peripheral wall 5.

After removing from the supporting frame 11, the plate member 10 is pressed to punch the flat area of the step section 19. By cutting the punched area, the vent holes 4 are formed. In this manner, the bonnet 1 of FIG. 1 is obtained. There is also a case where the bonnet 1 is heated at a predetermined temperature for a certain period time to release residual stress after forming especially the convex area 3 and the step section 19 where stress concentration is large, thereby removing the distortion. It is desirable that the temperature be about 150° C.~300° C. if the plate member 10 is made of steel materials.

It is also possible to form the upper surface 2 and the surrounding wall 5 at the same time during press operation. In this case, a range of the sequential forming which takes a comparatively long time can not only be minimized, but also the forming concave area 15 and the forming convex are 16 can be omitted to make a press die simple. As a result, it is possible to reduce the total cost.

According to the present sequential forming, since the flexible member 22 is softer than the main body 21 and formed in the hemispheric shape, it can establish softer spherical contact with the plate member 10. Thus, since the flexible member 22 does no longer make point contact with the plate member 10 and does not contact the plate member 10 at its edge in the direction of movement, production of tool marks can be reduced.

Further, the plate member 10 can be pushed and spread into the forming concave area 15 and the forming concave area 17 by the bar-shaped upper pushing member 20 for forming because the lower pushing member 13 is a concave die. It is therefore possible to prevent the creases from being produced at the periphery. Since this is a method suitable for sequential forming, it may not be suitable for mass-production, but can form products in a multi-kind and small quantity in a comparatively low cost.

FIG. 7A shows another embodiment of the upper pushing member 20 as seen from the direction perpendicular to the axis and FIG. 7B shows the flexible member 22 as seen from the direction of an arrow of FIG. 7A. FIG. 7C is a cross-sectional view as seen from the axial direction (i.e., the cross-sectional view along the line C—C of FIG. 7A. In these figures, the flexible member 22 is formed cylindrical made of the same material as the previous embodiment and inserted into a fork end section 24 provided at the tip of the main body 21 to be rotatably supported by an axis 25. The lower end section 21*a* in which the fork end section 24 is provided is secured to the main body 21 to be rotatable around the longitudinal axis, and the flexible member 22 is rotatably provided around the longitudinal axis of the main body 21.

In this manner, using the upper pushing member 20, the flexible member 22 is adapted to roll on and contact the surface of the plate member 10 for forming. Accordingly, it is possible to prevent the tool marks from being easily produced or from being prominent.

FIG. 8 is a view corresponding to FIG. 5 of a still further embodiment of the upper pushing member 20 showing the simplest structure. FIG. 8A shows the upper pushing member 20 as seen from the direction perpendicular to the axis. FIG. 8B is a cross-sectional view taken along the line B—B of FIG. 8A. The flexible member 22 is formed in a simple cylindrical shape and made of the same material as in each of the previous embodiments.

According to this structure, the flexible member 22 contacts the plate member 10 at its edge section in the moving direction, but it does not make an edge contact with the plate member 10 in reality due to the elasticity of the material. Accordingly, even in such a construction, it is possible to expect a certain degree of tool marks-reducing effect.

It is to be noted that the present invention is not limited to each embodiment described above, but can be varied or applied in various manners within the scope of the principle of the invention. For example, both the bar-shaped pushing member provided with the flexible member and the die-shaped pushing member with the concave die are not necessarily used at the same time, but either of them can be employed.

What is claimed is:

1. A sequential forming device comprising a plate member, a bar-shaped pushing member adapted to push the plate member from one side, and a die-shaped pushing member adapted to push the plate member from the other side, the plate member being inserted between the bar-shaped pushing member and the die-shaped pushing member, wherein a contacting section between the plate member and the bar-shaped pushing member is caused to move three-dimensionally to have the plate member formed into a predetermined three-dimensional shape, a section of the bar-shaped pushing member contacting the plate member is a flexible member and the die-shaped pushing member includes at least one concave area of a substantially oval shape and at least one convex area having stepped peripheral sections, the at least one concave area having a deep area and a shallow area.

2. The sequential forming device according to claim 1, wherein the flexible member is hemispheric.

3. The sequential forming device according to claim 1, wherein peripheries of the plate member are mounted on a supporting frame and are secured by a clamp.

4. The sequential forming device according to claim 1, wherein the plate member is made of a metal.

5. The sequential forming device according to claim 1, wherein the contacting section between the plate member and the bar-shaped pushing member forms contour lines in the plate member.

6. The sequential forming device according to claim 1, wherein the flexible member is formed as a cylindrical wheel and is inserted into a fork end section provided at a tip of the main body.

7. The sequential forming device according to claim 1, wherein the flexible member is provided on a lower end section of the main body.

8. The sequential forming device according to claim 1, wherein the flexible member is formed in a cylindrical shape and attached to an end of the main body.

* * * * *